US005236054A

United States Patent [19]

Jack et al.

[11] Patent Number: 5,236,054

[45] Date of Patent: Aug. 17, 1993

[54] COMBINATION CARRIER TRUCK AND UMBILICAL DRILLING RIG

[76] Inventors: Alexander D. Jack, 18 Elderberry, Irvine, Calif. 92660; William Honjas, P.O. Box 1125, Loyalton, Calif. 96118

[21] Appl. No.: 947,437

[22] Filed: Sep. 21, 1992

[51] Int. Cl.[5] ..... E21B 19/00

[52] U.S. Cl. ..... 175/57; 175/85

[58] Field of Search ..... 175/57, 85, 203; 166/77

[56] References Cited

U.S. PATENT DOCUMENTS

| | | | |
|---|---|---|---|
| 4,265,304 | 5/1981 | Baugh | 166/77 |
| 4,371,041 | 2/1983 | Becker et al. | 175/85 X |
| 4,591,007 | 5/1986 | Shaginian et al. | 175/85 |
| 4,703,811 | 11/1987 | Lam | 175/85 X |

*Primary Examiner*—Thuy M. Bui
*Attorney, Agent, or Firm*—Cislo & Thomas

[57] ABSTRACT

The present invention is a combination carrier truck and umbilical drilling rig (10) which can reach into confined locations has sufficient power and can drill without any undue noise and fumes. Its preferred embodiment comprises a carrier truck (14), which carries a power plant, a control system and a self propelled drill rig (54) which is designed to drill in confined locations and is carried on the truck bed to a place desired for drilling. The drill rig has all the necessary mechanisms for locomotion over rough terrain and for actuating drill tools (86). The drill rig (54) is connected to the truck (14) by a hose (24) through which power and control signals are transmitted which may be bypassed for direct connection between the carrier truck (14) and the drilling rig (54). While being transported the drill rig (54) is secured to the bed (16) of the carrier truck (14). The rig (54) can drill holes while secured to the bed (16) of the truck (14). Alternatively the drill rig (54) can be moved off the bed (16) of the truck (14) via a detachable ramp (100) and moved to a location remote from the truck where drilling operations can be carried out.

9 Claims, 3 Drawing Sheets

COMBINATION CARRIER TRUCK AND UMBILICAL DRILLING RIG

BACKGROUND OF THE INVENTION

The present invention relates to the field of drilling. More specifically the invention relates to drilling holes in the ground in confined spaces, hazardous conditions or even under water where the drilling rig's power plant may create a noise, vapor, flammability, explosive or contamination problem.

In many field of endeavor it is necessary to drill holes in the ground. Borings are needed for soil and groundwater investigations, for mineral exploration, or for blast holes. Major users of drilling rigs are the geotechnical and environmental industries. Others are the mineral and oil exploration industries. If the location desired for drilling is outdoors, such as in mineral exploration, one can transport a portable drill rig to or erect a drill rig at the desired location.

Examples of portable drill rigs abound in the patent literature. U.S. Pat. No. 3,682,253 describes a mobile mounting frame for rock working tools having universally movable tool positioning and operatively supporting means. U.S. Pat. No. 3,088,531 shows a self propelled rock drill cruiser, providing stability on uneven terrain, where the rock drill positioning boom is hydraulically operated and the drill is actuated by compressed air. U.S. Pat. No. 3,565,184 is for a drill rig comprising a foldable two-part boom structure mounted with one end at a mobile chassis for lateral and vertical swinging. A feed bar for a rock drill is mounted at the outer end of the boom structure for universal pivoting. U.S. Pat. No. 4,088,289 shows a portable drill rig having a pair of telescoping struts which are connected at their upper ends to an elongated mast support member. This drill rig includes a crawler under-carriage. U.S. Pat. No. 3,664,436 shows an adjustable mounting for a rock drill having a feed tilt mechanism. This mechanism is mounted on a crawler track. U.S. Pat. No. 2,854,251 describes an improved mobile rock drill rig having an improved adjustable supporting structure, which is mounted on an improved mechanized crawler which can traverse rough terrain. U.S. Pat. No. 2,842,340 is drawn to an improved drill carriage mounted on endless trackways that form traction members for the carriage and are driven by air operated motors. U.S. Pat. No. 3,722,601 shows a drill rig with a detachable crawler. U.S. Pat. No. 3,642,075 covers a rock drilling vehicle adapted to have one or more rock drills mounted on it. The vehicle has places for mounting power plants and storing operating fluids.

Many portable drill rigs are commercially available. Examples are the models B-80, B-57 and B-61 HDX manufactured by Mobile Drilling Company, Inc. of Indianapolis, Indiana; and the models A-200, A-300, and T3W manufactured by Ingersoll Rand. Each of these has a drilling system mounted on the rear of a flat bed truck, so that drilling can be conducted off the end of the truck. The drilling system can be folded down, typically over the cab of the truck, for transportation from one drilling site to another.

Typically the drill rigs described above are tall, noisy, generate objectionable fumes and, because they include an internal combustion engine, are inherently unsafe in flammable or explosive atmospheres or in confined spaces with limited access or poor air circulation. They need to be tall to handle the sampling tools used as well as the drill pipe and augers used in the drilling operation. These are not major obstacles if drilling can be done outdoors. If the location desired for drilling is outdoors on relatively level solid ground, one can transport a portable drilling rig to any desired location.

There are also several examples of remotely controlled under water equipment. U.S. Pat. No. 3,626,963 shows an underwater bulldozer that can be suspended from a ship. Electrical control signals are transmitted from a control panel, carried by a diver, to the bulldozer. U.S. Pat. No. 5,042,959 describes an undersea operating system, for construction, moving of rocks etc., comprising a machine having a vehicle and an articulated arm, which is suspended from and controlled by a ship. Hydraulic power is provided to the machine from the ship via a special cable. Neither of these inventions is designed for underwater drilling, however.

Frequently, in geotechnical/environmental applications, it is necessary to drill in confined places, such as inside a building. Here, getting the rig to the desired location is a major problem. There are several rigs designed for drilling in confined locations. One such rig is described in U.S. Pat. No. 3,784,159. This patent describes a drill rig comprising a mobile chassis, rock drill supporting means and hydraulic jacks. Another such rig is shown in U.S. Pat. No. 3,490,546. This patent shows a transportable boring machine constructed to have a relatively short transport position height so that the machine may ne moved through relatively small tunnels. These rigs may be movable through small tunnels but they still need considerable mast height for drilling. Furthermore, fumes and noise can render the location hazardous for operators and the fumes have been known to affect boring monitoring equipment.

There are even hand held drills such as those shown in U.S. Pat. Nos. 4,116,284 and 3,705,632. The former is powered by a separate power plant which rolls after the operator on wheels. The latter is designed to be operated remotely by the electrical system of a snowmobile. Hand held drill rigs such as these can be underpowered, thus making the drilling task difficult and time consuming.

Development of a drill rig which can reach into locations which are confined or may have limited access, has sufficient power, and can drill without any undue noise, fumes, or ignition potential would represent a great improvement in the drilling field and would satisfy a long felt need of the geotechnical/environmental industry. Development of a self propelled drill rig which had a remote source of power would likewise represent a great improvement in the underwater drilling field. There is substantial demand for such a drilling rig that can perform all of the above functions, yet can also serve the more mundane tasks of prior art drilling rigs. Versatility and economy are paramount considerations in the selection of a drilling rig.

SUMMARY OF THE INVENTION

The present invention is a combination carrier truck and umbilical drilling rig which can reach into locations where access is restricted, and drill either while mounted to its carrier truck, or if need be, trundled off it carrier truck and operated independently. The invention has sufficient power for most drilling requirements, and yet, can drill without any undue noise and fumes, and can operate safely in flammable or explosive atmospheres. The drill can perform its drilling functions while secured on the rear of its carrier truck without unloading, thus providing a high degree of versatility and convenience. Its preferred embodiment comprises a carrier truck, which carries a power plant, a control system and a self propelled drill rig which is designed to drill in confined locations and is carried on the truck bed to a place desired for drilling. The rig and its power source can also be mounted on a skid or a trailer if required.

The drill rig has no power plant of its own but has all the necessary mechanisms for locomotion over rough terrain, for turning augers, other drill implements and winches, for actuating lift rams and for energizing mast hydraulics or other related hydraulic equipment. The drill rig is connected to the truck by a hose, wire or cable as the power source may dictate. There is a generous supply of this hose, wire or cable wound around a reel which is also attached to the truck bed. Power and control signals are transmitted to the drill rig via this hose, wire or cable. The reel can be bypassed where the drilling rig is used mounted on the carrier truck bed.

While being transported, the drill rig is secured to the bed of the carrier truck. It is secured so that the drill tools are suspended off the rear of the bed. Thus the drill rig can be used for drilling holes when secured to the bed. All that is required is that the truck be moved into the desired location. Drilling deep holes is accomplished in the normal way by attaching a drill string attaching the upper end of the drill string to the drill head and allowing any drill steel used to dig into the earth until the upper end of the drill steel is close to the surface. At this point another drill steel section is inserted between the drill head and the drill steel already in the ground. Withdrawing the drill steel is accomplished by spinning the shaft or pipe so that the drill steel does not catch on the side of the hole, and using the rig's mast hydraulics to lift the drill steel or pipe out of the hole. As each section of drill steel or pipe is withdrawn from the hole, it is removed.

For geotechnical/environmental sampling, a down hole hammer is used with a split spoon sampler. The down hole hammer can either be mechanically operated via a cable or hydraulically operated via a solid rod. The rig is provided with auxiliary hydraulic hoses, stored on reels, for this and other tasks involved in drilling. Since drilling conditions vary greatly, the drilling rig is designed to drill using hollow stem augers for most geotechnical/environmental applications, reverse air rotary augers for hard rock and mineral applications, and mud rotary augers for water well applications<as well as conventional drill for other applications.

Alternatively, if the truck cannot be moved to the location desired for drilling the drill rig can be moved off the bed of the truck via a ramp which may or may not be detachable, and moved to a location remote from the truck. The hose, cable or wire pays out from the reel as the drill rig is moved away from the truck. Distance is limited by the length of the hose, cable or wire. Because of its small size and limited mast height, the drill rig can be moved through confined locations, such as the hallways of a building. It can then be used for drilling holes at this location. Because the power plant is then remote from the drill rig, the noise, exhaust fume, heat and ignition potential do not interfere with drilling operations. This provides the operators with a safer work environment and eliminates interference with any vapor monitoring equipment that may be used. To provide a level drilling platform and stability to the rig while drilling, the truck and the drill rig are provided with stabilizing jacks.

To change the angle of boring, the mast of the drilling rig is simply rotated to the required angle. In the case where a hole is being re-entered or hole alignment is required, the drilling mast can be moved backwards and forwards during drilling. This can be done by moving the truck, while the rig is on its bed, or by moving the rig itself, while the rig is out on its umbilical hose. Also, the hydraulics associated with the drilling rig can be used to adjust the longitudinal and perpendicular positioning of the drilling mast relative to the axis of the carrier truck and the hole to be bored.

Since the power for the combination carrier truck and umbilical drilling rig is remote from the drill rig itself, drilling operations can even be carried out under water or in oxygen deficient atmospheres.

An appreciation of the other aims and objectives of the present invention and a more complete and comprehensive understanding of it may be achieved by referring to the accompanying drawings and studying the following description of a preferred embodiment.

DETAILED DESCRIPTION OF THE PREFERRED EMBODIMENT

Figures 1A, 1B:
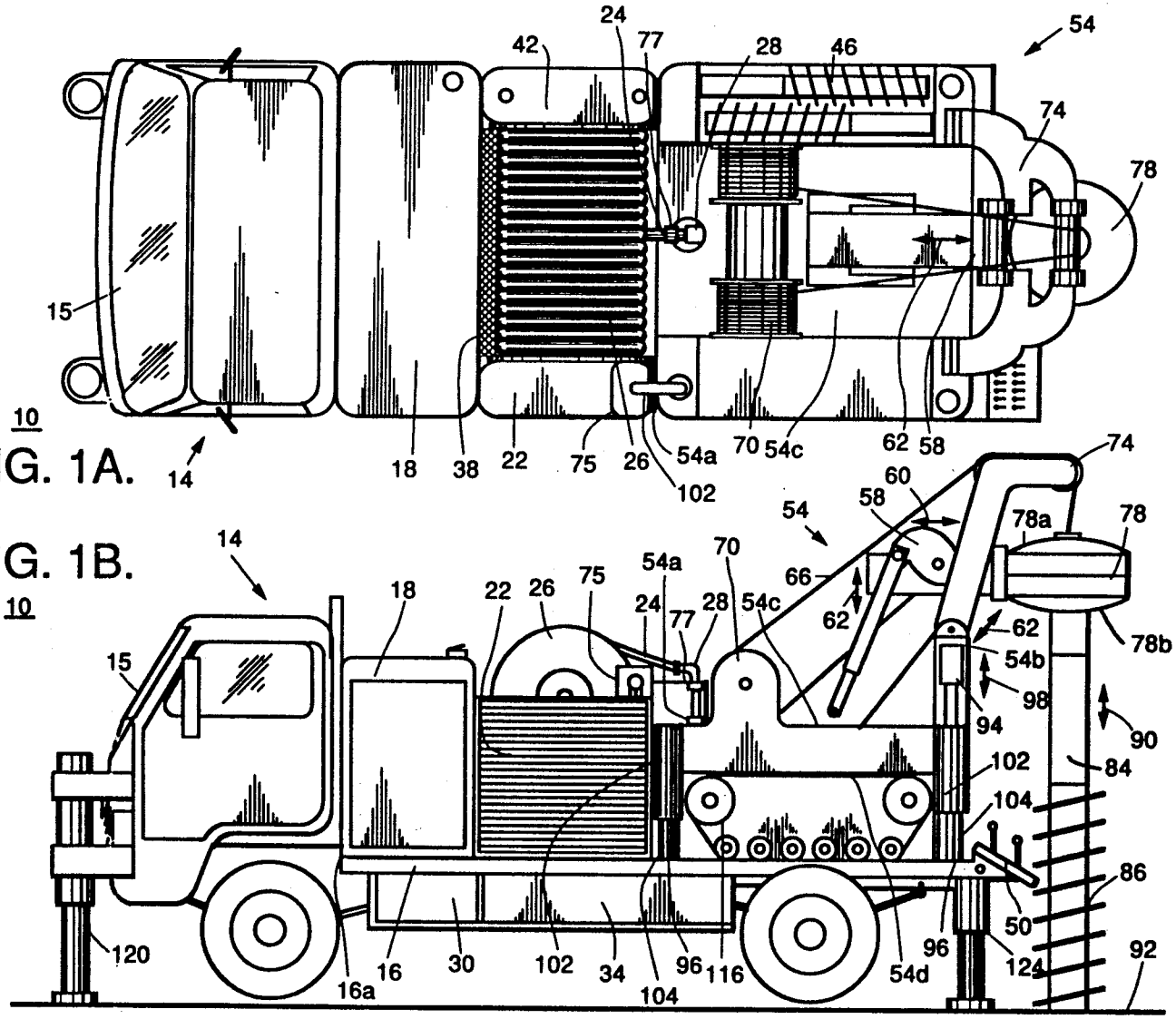
FIG. 1A is a side view of the drill rig secured to the bed of the carrier truck and ready to drill.
FIG. 1B is a top view of the drill rig and truck shown in FIG. 1A.

FIG. 1 shows views of the preferred embodiment of the combination carrier truck and umbilical drilling rig 10 of this invention. The carrier truck 14 can be any kind of truck of adequate size which has an accessible truck bed 16. The illustration shows a typical industrial, flat bed truck. Mounted towards the front end **16*a* of the truck bed 16 is a compressor 18. The compressor 18 is used to provide power for drilling using the rotary air method. Rearward of the compressor 18 is a hydraulic pump 38. On either side of the hydraulic pump 38 are a hydraulic radiator 22 and a hydraulic storage tank 42. Hydraulic power is generally used to power all other mechanisms on board the drill rig 54. While the combination of hydraulic and pneumatic power described above is preferred, versions of the combination carrier truck and umbilical drilling rig 10** could be designed to run on pneumatic power, hydraulic power, electric power, or combinations of these.

Above the hydraulic pump 38 is a quantity of umbilical hose 24 stored on a hose reel 26. At the rear **16*b* of the bed 16 is a control panel 50. Also located on the truck 14 are a storage compartment 30 and a pipe rack 34. Tools and supplies may be stored in the storage compartment 30 or additionally or alternatively place upon the drilling rig 54. Sections of drill pipe 84 are stored on the rack 34. While preferred placement of these items on the truck bed is indicated on FIG. 1 it should be recognized that exact placement is not critical so long as a power plant, a control system and means for paying out and retrieving the umbilical hose 24** are provided.

Mounted on the front of the truck is a front stabilizing jack 120. Mounted off the rear of the truck bed are a pair of rear stabilizing jacks 124. Again the exact design and placement of these jacks 120, 124 are not critical, provided that a means for stabilizing the truck is furnished.

FIG. 1 also shows the drill rig 54 secured to the rear 16*b* of the truck bed 16. The means for securing 56 the rig 54 are not illustrated since the rig 54 could be secured by any convenient means, including pins, bolts, cables, hydraulic rams, locking cams and chains. The rig 54 has caterpillar tracks 116 which protrude past its lower surface 54*d*. These tracks 116 allow the rig 54 to move easily over berms, curbs and rough terrain. While caterpillar tracks 116 are preferred, any other means of locomotion that will provide the ability to traverse rough terrain or increased mobility can be utilized. The rig 54 also has a fairly conventional drilling mechanism suspended off its rear 54*b*. The preferred embodiment has a drilling mast 58 attached to its upper surface 54*c*.

The drilling mast 58 projects towards the rear 54*a* of the rig 54 where it is joined to a rotating head 78. The drilling mast 58 is articulated at several points so that it can move fore and aft, up and down and rotate about a pivot point 60. These directions of motion are shown by the arrows 62. This allows for drilling at any desired angle. The rotating head 78 is cylindrical and contains an impeller 79, not visible on FIG. 1, for converting hydraulic fluid or compressed air, whichever is supplied, to torque. The rotating head 78 is suspended on the mast 58. Two support cables 66 run over a cable mast 74 to a cable spool 70 which is also attached to the top 54*a* of the rig 54. The cables 66 are used for suspending sampling tools, not illustrated, or lifting the auger 86 or sections of drill pipe 84.

The rotating head 78 has an adapter 80 protruding from its lower surface 78*b*. The adapter 80 rotates in the direction shown by the arrow 82. Sections of drill pipe 84 can be fastened to the adapter 80. Then an auger 86 can be fastened to the pipe 84. In this manner, as the auger 86 bores deeper and deeper, the highest section of pipe 84 can be unbolted from the adapter 80 and another section of pipe 84 bolted in place. The process is reversed when withdrawing the auger 86 from the hole.

The mast 74 is supported by a hydraulically actuated support 94 which has a direction of motion shown by the arrow 98. Lowering this support 94 allows the rotating head 78 and cable mast 74 to be lowered so that the drilling rig 54 can be moved via a detachable ramp 100 to ground level 92. These parts of the rig 54 can also be lowered to allow the rig 54 to move through small tunnels or passageways.

Additionally, the drilling rig 54 has four stabilizing jacks 102. When the rig 54 is secured to the truck bed 16, the feet 104 of the jacks 102 are sunk into wells 96 in the bed 16. This prevents lateral motion of the rig 54 while the truck 14 is moving and provides stability while the rig 54 is being used for drilling while it is still on the truck bed 16. Also located on the upper surface 54*c* of the rig 54 is another pipe storage rack 46. Finally the rig can have a junction box 28 to which the umbilical hose 24 is connected. The hose reel 26 can be bypassed by way of a hydraulic/air junction bypass valve 75 associated with a bypass hose 76 having quick release hose attachments associated with both the drilling rig 54 and the carrier truck 14. The drill rig 54 is secured to the truck bed 16 so that the cable mast 74 and the rotating head 78 clear the rear 16*b* of the truck. This allows attachment of pipe sections 84 and the auger 86 so that drilling can be accomplished while the rig 54 is still secured to the truck 14.

The size of the rig 54 is about 8 feet long by 5 feet wide. This is small enough so that it can be easily maneuvered inside a standard building. Additionally, the mast height is between about 5 to 14 feet. This is small enough so that drilling can be conducted inside a standard building. The drill rig of this invention will drill holes to about 300 feet. It will have a maximum torque of around 500 lb. ft., a pulldown of approximately 18,500 lbs. and a pull back force of around 28,000 lb.

While the preferred configuration of the rig 54 has been described above, it should be understood that the exact configuration is not essential so long as the rig 54 has a means for locomotion over rough terrain or normally inaccessible areas, a means for drilling successively deeper holes, a means for stabilization, and its size is small enough to allow it to be fully operated inside a standard building. The invention also has the ability to drill while the rig 54 is mounted on the carrier 14 which significantly increases the versatility and convenience of the drilling rig 54.

It must be understood that the rig 54, while having all requisite mechanisms to allow all the various component parts to be fully actuated, has no on-board source of power. Power must be supplied from outside via the junction box 28. Power is distributed from the junction box by a manifold 56, not visible on the figure, internal to the rig 54, to each mechanism that can be actuated. Thus when the term self propelled is used in conjunction with the drill rig 54, it must be understood to imply the capability for self propulsion with power supplied from an external source.

Figure 2:
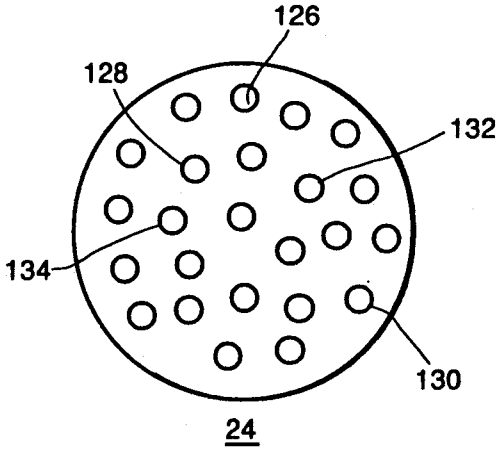
FIG. 2 is a cross-section of a typical umbilical hose.
Figure 3:
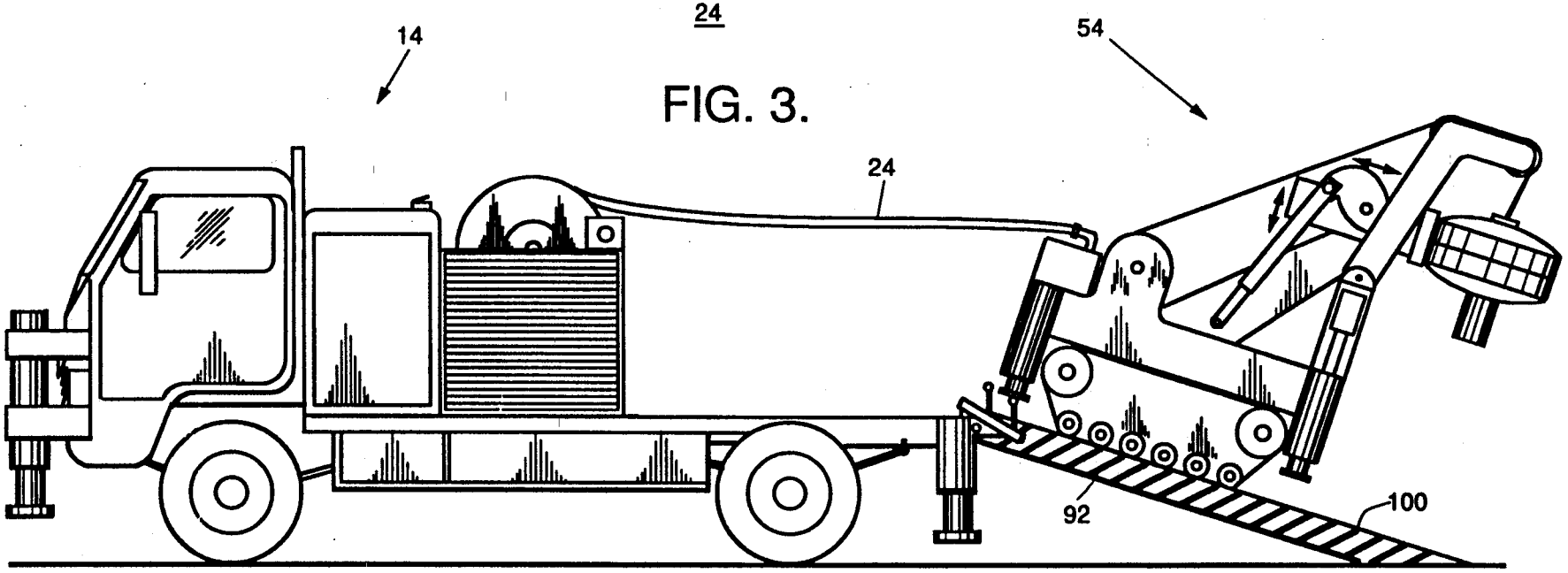
FIG. 3 depicts the drill rig descending from the truck bed via the detachable ramp.
Figure 4:
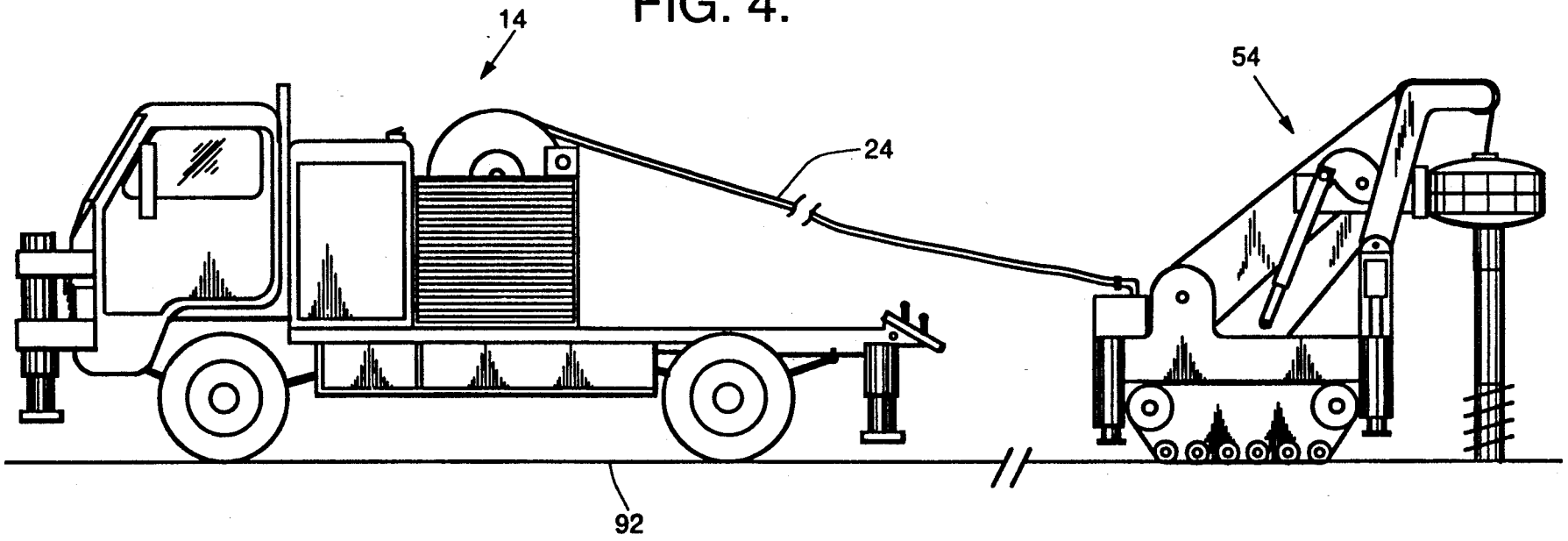
FIG. 4 depicts the drill rig drilling at a location remote from the truck.

FIG. 2 shows a cross-section of the preferred umbilical hose 24. As can be seen from the figure, the hose contains hydraulic fluid lines 126, hydraulic fluid return lines 128, and air lines 130. Mud lines 132 and electrical circuits 134 can be added as necessary. For simplicity only one of each type of line has been designated. The exact design of this hose 24 is not critical provided it is capable of transmitting power and control signals to the necessary mechanisms on board the rig 54. The hose 24 is connected from the compressor 18, the hydraulic pump 38, and the control box 50 to the junction box 28 on the rig 54. Preferably, the hose 24 will be long enough to allow operation of the rig 54 up to 300 feet away from the truck 14.

The combination carrier truck and drilling rig 10 is operated as follows. Originally the drill rig 54 will be secured to the bed 16 of the truck 14. The jack feet 104 will be down to provide stability. All sections of pipe 84 and the drill tools 86 will be stowed. The truck 14 will be driven to the site desired for drilling. If the actual drill location is accessible to the truck 14, it will be maneuvered until the rotating head 78 is located over the desired location. The jacks 120 and 124 will be lowered to stabilize the truck. Then a section of pipe 84 will be attached to the adapter 80, and the auger 86 attached to the pipe 84.

With power provided from sources on the truck 14, via the umbilical hose 24, or if desired, directly associated to the power source located upon the carrier truck 14, drilling will commence. The rig 54 will be controlled by an operator located at the control console 50. As the auger 86 goes deeper and deeper, additional sections of pipe 84 will be added. The rotating head 78 will be lifted free of the sections of pipe 84 by means of the drilling mast 58. There will be enough power so that holes of around 300 feet can be easily drilled. The process of drilling with the rig 54 secured to the truck 14 is illustrated in FIG. 1.

After the hole is drilled to the desired depth, the auger 86 will be lifted out of the hole by use of the mast's 58 hydraulic power. As each section of pipe 84 is lifted clear of the ground 92, it will be removed and the rotating head 78 lowered and attached to the section 84 still in the ground 92. This process will be repeated until the auger 86 is finally lifted clear of the ground 92.

If the desired hole location is not accessible to the truck 14, for example inside a building, then detachable ramps 100 will be placed against the rear **16*b* of the truck 14. The rig 54 will then be moved off the bed 16 of the truck 14. Again, power and control signals will be provided from sources on the truck 14, via the umbilical hose 24. Before the rig 54 can be moved off the truck 14, though, the cable mast 74 and drill mast 58** must be lowered into transportation position.

Once the rig 54 is on the ground, it will be maneuvered by the operator by control signals generated at the control console 50. The console 50 is removable so that it can be moved from the back of the truck to the side of the rig 54. The caterpillar tracks 116 will allow the rig 54 to traverse curbs, berms and rough terrain with slopes of up to 47 degrees. The hose 24 will allow the rig 54 to operate at distances up to 300 feet from the truck 14. Once the rig 54 is in the desired location, the cable mast 74 and the drill mast 58 will be raised again, the jack feet 104 will be lowered to stabilize the rig 54 and drilling will proceed as described above.

The combination carrier truck and umbilical drilling rig 10 has been described with reference to a particular embodiment. During this description mention has been made of alternate configurations and non-essential elements of the design. In particular, a hose has been described as a conduit for providing an energy source such as hydraulics or pneumatics. However, other power sources may be utilized, and hence other conduits of power supplies may be utilized such as a cable for electricity, etc. It should also be obvious to those skilled in the art to which this invention pertains that other modifications and enhancements can be made without departing from the spirit and scope of the claims that follow.

What is claimed is:

1. A combination carrier truck and umbilical drilling rig comprising:

a carrier truck which includes a source of power and a source of control signals; said carrier truck having a bed; said bed having a ramp;

a self propelled drill rig which can be carried on said truck bed to a place desired for drilling; and a hose, flexibly connecting said self propelled drill rig to said carrier truck, which transmits said power and said control signals on demand to said self propelled drill rig so that said self propelled drill rig can be used for drilling holes when held on said carrier truck; and said self propelled drill rig can be moved off said carrier truck via said ramp, moved to a location remote from said carrier truck, and used for drilling holes at said location.

2. A combination carrier truck and umbilical drilling rig as claimed in claim 1, further comprising means for stabilizing said self propelled drill rig during drilling.

3. A combination carrier truck and umbilical drilling rig as claimed in claim 1, further comprising means for payout and retrieval of said hose.

4. A combination carrier truck and umbilical drilling rig comprising:

a drill means for drilling holes; said drill means including a propulsion means for propulsion upon demand of said drill means over uneven terrain, a boring means for boring at any desired angle of attack, an extension means for extending the reach of said boring means so that successively deeper holes can be drilled, a withdrawing means for withdrawing said boring means and said extension means from completed holes, and a stabilizing means for stabilizing said drill means during boring;

a carrier means for holding said drill means, for moving said drill means to locations where holes must be drilled, and for providing a source of power and control signals; said carrier means having a bed;

a ramp means for allowing said drill means to descend and ascend to and from said bed of said carrier means; and an umbilical means, flexibly connecting said drill means to said carrier means, for transmitting said power and said control signals from said carrier means to said drill means so that said drill means can be used for drilling holes when held on said carrier means; and said drill means can be moved off said carrier means via said ramp means, moved to a location remote from said carrier means, and used for drilling holes at said location.

5. A combination carrier truck and umbilical drilling rig as claimed in claim 4, further comprising means for payout and retrieval of said umbilical means.

6. A combination carrier truck and umbilical drilling rig comprising:

a drill rig having a front and a rear and including means for propulsion of said drill rig upon demand over uneven terrain, drill tools, means for supporting said drill tools to the rear of said drill rig, means for imparting torque to said drill tools, means for adjusting the angle of attack of said drill tools, means for extending the reach of said drill tools so that successively deeper holes can be drilled, means for withdrawing said drill tools and said means for extension from completed holes, and means for stabilizing said drill means during boring;

a carrier truck having a truck bed and including means for securing and un-securing said drill rig to said truck bed at will, means for providing a source of power and means for providing control signals;

a ramp which can be placed when desired between said truck bed and ground level; and an umbilical hose, flexibly connecting said drill rig to said carrier truck, whereby said power and said control signals can be transmitted from said carrier truck to said drill rig so that said drill rig can be used for drilling holes when held on said carrier truck; and said drill rig can be moved off said carrier truck via said detachable ramp, moved to a location remote from said carrier truck, and used for drilling holes at said location.

7. A combination carrier truck and umbilical drilling rig as claimed in claim 6, further comprising a supply of said umbilical hose and means for payout and retrieval of said umbilical hose.

8. A method of drilling holes comprising the steps of:

(a) providing a carrier truck, having a bed, which includes a source of power and a source of control signals;

(b) providing a ramp which can be placed between said bed and ground level;

(c) providing a self propelled drill rig;

(d) providing a power and signal transmitting hose, flexibly connecting said self propelled drill rig to said carrier truck, which transmits said power and said control signals from said carrier truck to said self-propelled drill rig;

(e) securing said drill rig on said bed of said carrier truck;

(f) moving said carrier truck with said drill rig to a first location desired for drilling; and (g) drilling a hole with said drill rig at a desired angle of attack at said first location.

9. A method of drilling holes as claimed in claim 8 in which said step of drilling further includes:

(a) un-securing said drill rig from said bed of said carrier truck;

(b) moving said drill rig off said bed of said carrier truck via said ramp;

(c) moving said drill rig to a second location remote from said carrier truck;

(d) drilling a hole at a desired angle of attack at said second location;

(e) moving said drill rig back onto said bed of said carrier truck; and (f) re-securing said drill rig onto said bed of said carrier truck.

* * * * *